US010374362B2

(12) United States Patent
Degner et al.

(10) Patent No.: US 10,374,362 B2
(45) Date of Patent: Aug. 6, 2019

(54) INTEGRATED PROTECTOR FOR A CONNECTOR

(71) Applicant: Apple Inc., Cupertino, CA (US)

(72) Inventors: Brett W. Degner, Menlo Park, CA (US); Rui Zhou, Sunnyvale, CA (US); Mahmoud R. Amini, Sunnyvale, CA (US); Daniele G. de Iuliis, San Francisco, CA (US); James M. Jeon, Mountain House, CA (US); Erik A. Gutfeldt, Cupertino, CA (US)

(73) Assignee: Apple Inc., Cupertino, CA (US)

( * ) Notice: Subject to any disclaimer, the term of this patent is extended or adjusted under 35 U.S.C. 154(b) by 12 days.

(21) Appl. No.: 15/720,496

(22) Filed: Sep. 29, 2017

(65) Prior Publication Data

US 2018/0351301 A1 Dec. 6, 2018

Related U.S. Application Data

(60) Provisional application No. 62/515,493, filed on Jun. 5, 2017.

(51) Int. Cl.

| | |
|---|---|
| ***H01R 13/64*** | (2006.01) |
| ***H01R 13/453*** | (2006.01) |
| *H01R 12/72* | (2011.01) |
| *H01R 24/62* | (2011.01) |
| *H01R 107/00* | (2006.01) |

(52) U.S. Cl.
CPC ..... *H01R 13/64* (2013.01); *H01R 13/4536* (2013.01); *H01R 12/722* (2013.01); *H01R 24/62* (2013.01); *H01R 2107/00* (2013.01)

(58) Field of Classification Search
CPC .... H01R 13/64; H01R 13/4536; H01R 13/44; H01R 13/447; H01R 13/453
USPC ..... 439/38, 135–150, 374
See application file for complete search history.

(56) References Cited

U.S. PATENT DOCUMENTS

| | | | |
|---|---|---|---|
| 4,420,157 | A | 12/1983 | White et al. |
| 4,480,884 | A | 11/1984 | Babuka et al. |
| 4,717,349 | A | 1/1988 | Johnson |
| 4,759,726 | A | 7/1988 | Naylor et al. |
| 4,973,859 | A | 11/1990 | Shodai |

(Continued)

OTHER PUBLICATIONS

U.S. Appl. No. 15/275,227 (unpublished), filed Sep. 23, 2016, entitled, "Gated Connector Receptacles," 39 pages.

*Primary Examiner* — Travis S Chambers
(74) *Attorney, Agent, or Firm* — Kilpatrick Townsend & Stockton, LLP

(57) ABSTRACT

Connector receptacles having protective doors. A protective door can block a card, module, or connector insert from being inserted at an oblique angle to protect contacts in a connector receptacle from damage due to an improper insertion. The protective door can normally be closed in the absence of a card inserted in the connector receptacle. The door can be a front of a cam. A spring or magnet can bias the door in the closed position when no card is inserted. The door can be arranged to stay closed when a card is inserted at an oblique angle. When the card is inserted properly, the cam can rotate about an axis and the door can open allowing the card to access to the contacts of the connector receptacle. A second door in front of the protective door can be included to provide enhanced functionality and to provide a more uniform appearance.

20 Claims, 16 Drawing Sheets

(56) References Cited

U.S. PATENT DOCUMENTS

| | | | | |
|---|---|---|---|---|
| 5,013,256 | A | 5/1991 | Matsuoka et al. | |
| 5,231,274 | A | 7/1993 | Reynier et al. | |
| 5,559,672 | A | 9/1996 | Buras | |
| 6,068,516 | A | 5/2000 | Chang | |
| 6,377,451 | B1 * | 4/2002 | Furuya | G06F 1/1616 360/99.02 |
| 6,511,350 | B1 | 1/2003 | Ito et al. | |
| 6,547,585 | B2 | 4/2003 | Bradley | |
| 6,558,175 | B1 * | 5/2003 | Yu | G06K 13/0875 361/737 |
| 6,663,403 | B2 | 12/2003 | Hsu | |
| 6,843,670 | B2 | 1/2005 | Yamaguchi et al. | |
| 6,851,959 | B2 | 2/2005 | Ooya et al. | |
| 6,929,491 | B1 | 8/2005 | Chi-Te | |
| 6,947,290 | B2 | 9/2005 | Hirata | |
| 7,108,530 | B2 | 9/2006 | Kimura | |
| 7,114,968 | B2 | 10/2006 | Healy | |
| 7,275,963 | B2 | 10/2007 | Kurita | |
| 7,431,595 | B1 | 10/2008 | Yen | |
| 7,651,348 | B2 | 1/2010 | Huang et al. | |
| 7,794,281 | B2 | 9/2010 | Matsumoto et al. | |
| 7,887,370 | B2 | 2/2011 | Chen | |
| 7,907,419 | B2 * | 3/2011 | Costello | H05K 7/142 174/138 E |
| 8,636,526 | B2 | 1/2014 | Funamura | |
| 8,764,465 | B2 | 7/2014 | Huang | |
| 9,601,861 | B2 | 3/2017 | Kanamori | |
| 9,742,096 | B2 | 8/2017 | Lee | |
| 2003/0092310 | A1 | 5/2003 | Kunishi et al. | |
| 2009/0068897 | A1 | 3/2009 | Jin | |
| 2009/0221184 | A1 | 9/2009 | Matsumoto et al. | |
| 2009/0298321 | A1 | 12/2009 | Sakiyama et al. | |
| 2017/0133805 | A1 | 5/2017 | Lewis | |

* cited by examiner

INTEGRATED PROTECTOR FOR A CONNECTOR

CROSS-REFERENCES TO RELATED APPLICATIONS

This application claims the benefit of U.S. provisional application No. 62/515,493, filed Jun. 5, 2017, which is incorporated by reference.

BACKGROUND

The number and types of electronic devices available to consumers have increased tremendously the past few years and this increase shows no signs of abating. Electronic devices, such as portable media players, storage devices, tablets, netbooks, laptops, desktops, all-in-one computers, wearable computing devices, cell, media, and smart phones, televisions, monitors, and other display devices, navigation systems, and other devices have become ubiquitous.

These electronic devices can include one or more connector receptacles, which can often appear as a cavity on a side of an electronic device. These receptacle cavities can be arranged to receive a second electronic device or a connection to a second electronic device. For example, they can be arranged to receive a device such a memory or circuit module device. These devices can include cards such as Secure Digital cards, memory sticks, compact flash, wireless transceivers, and other types of cards and modules. The receptacle cavity can also be arranged to receive a connector insert, which can be connected to a cable, a docking station, or other electronic component.

These devices have become smaller and slimmer with each succeeding generation. At the same time, they have been designed to include ever-increasing levels of functionality. The trend for the foreseeable future is to pack more features into increasingly smaller devices. As a result, many components of these devices, such as casings, power supplies, and circuits have become smaller. It can be desirable to further reduce the size of other components as well. For example, it can be desirable to reduce the size of these connector receptacles. Space saved by providing a reduced size connector receptacle can be used to shrink the size of the electronic device, it can be used to increase functionality, or both.

A connector receptacle can include a number of contacts to mate with contacts on these devices or inserts. These electrical connections pathways can form paths for power and data. When a connector receptacle is made smaller, for example shallower, its contacts can be more vulnerable to damage by improper card or connector insertion.

Thus, what is needed are connector receptacles having protective structures for connector contacts.

SUMMARY

Accordingly, embodiments of the present invention can provide connector receptacles having protective structures for connector contacts. An illustrative embodiment of the present invention can provide a connector receptacle having one or more protective doors to protect contacts in the connector receptacle. The protective doors can protect contacts in a connector receptacle from damage when a device, module, or connector insert is improperly inserted into the connector receptacle, for example at an oblique angle. The protective doors can also prevent the ingress of moisture, dust, debris, or other particulate matter.

These and other embodiments of the present invention can provide a connector receptacle having a protective door. The protective door can block a card, module, or connector insert (referred to simply as card) from being inserted at an oblique angle. This can help to protect contacts in the connector receptacle from damage due to an improper insertion. The protective door can normally be closed in the absence of a card inserted in the connector receptacle. A spring or magnet can bias the door in the closed position when no card is inserted to prevent the entry of moisture or particulate matter. The door can be arranged to stay closed when a card is inserted at an oblique angle. When the card is properly inserted, the door can open allowing the card to access to the contacts of the connector receptacle.

In these and other embodiments of the present invention, the door can extend across a front opening of the connector receptacle. The door can be a front portion of a cam, and the cam can be hinged along an axis. The door can have a front face having a forward ramp on or towards one side of the opening. This forward ramp can begin at or near the hinged axis and can slope downward at an angle deeper into the connector receptacle. The remaining portion of the front face can be flat, it can be a reverse going ramp, or a combination of these. That is, remaining portion of the front face can begin at the deepest point of the forward going ramp, and can slope upward at an angle deeper into the connector receptacle. In short, it can be sloped in an opposite direction as the forward ramp. A properly inserted card can engage the forward ramp. The forward ramp can slide along a front edge of the card as the card is inserted, thereby rotating the cam along its axis. This can move the door out of the way of the card. The card can then engage the contacts of the connector receptacle. An improperly inserted card can engage the reverse ramp. Engaging the reverse ramp can push the door closed, thereby protecting the contacts of the connector receptacle.

In these and other embodiments of the present invention, features can be added to improve the functionality and appearance of the door. For example, the reverse ramp portion can be filled with an elastomer or other material to provide a more uniform appearance. Instead of improving the appearance of a first door having a mix of features, a second door having a more uniform appearance can be placed in front of the first door. A properly inserted card can move the second door out of the way. The properly inserted card can then engage the ramp on the first door, moving the first door out of the way, as before. The card can then access the contacts of the connector receptacle. An improperly inserted card can still move the second door out of the way, but can then engage the reverse ramp of the second door, pushing the second door closed and protecting the contacts of the connector receptacle.

These and other embodiments of the present invention can add features to the cams and springs to reduce or maintain the force needed to actuate the cam and move the door throughout the insertion of a card. For example, the spring and cam can contact at points that are optimized to reduce the insertion force needed to move the door out of the way. The forward ramp can have a profile that is arranged to reduce or maintain the force required to actuate the cam and move the door throughout the insertion of a card. This can be done by providing a profile where an angle of incidence is reduced during an insertion of a card.

In various embodiments of the present invention, the components of connector receptacles can be formed in various ways of various materials. For example, contacts or pins and other conductive portions of the receptacles can be formed by stamping, metal-injection molding, machining, micro-machining, 3-D printing, or other manufacturing process. The conductive portions can be formed of stainless steel, steel, copper, copper titanium, phosphor bronze, or other material or combination of materials. They can be plated or coated with nickel, gold, or other material. The nonconductive portions, such as the protective pieces, the receptacle housings and other portions, can be formed using injection or other molding, 3-D printing, machining, or other manufacturing process. The nonconductive portions can be formed of silicon or silicone, rubber, hard rubber, plastic, nylon, elastomers, liquid-crystal polymers (LCPs), ceramics, or other nonconductive material or combination of materials.

Embodiments of the present invention can provide connector receptacles that can be located in, and can connect to, various types of devices, such as portable computing devices, tablet computers, desktop computers, laptops, all-in-one computers, wearable computing devices, cell phones, smart phones, media phones, storage devices, portable media players, navigation systems, monitors, power supplies, adapters, remote control devices, chargers, and other devices. These connector receptacles can provide pathways for signals and power for cards or other modules, such as Ultra-High-Speed II Secure Digital cards, Secure Digital cards, Secure Digital High Capacity cards, Secure Digital Extended Capacity cards, Secure Digital Ultra-High-Capacity I cards, Secure Digital Ultra-High-Capacity II cards, memory sticks, compact flash cards, communication modules, and other devices and modules that have been developed, are being developed, or will be developed in the future. These connector receptacles can provide pathways for signals that are compliant with various standards such as Universal Serial Bus (USB), High-Definition Multimedia Interface® (HDMI), Digital Visual Interface (DVI), Ethernet, DisplayPort, Thunderbolt™, Lightning™, Joint Test Action Group (JTAG), test-access-port (TAP), Directed Automated Random Testing (DART), universal asynchronous receiver/transmitters (UARTs), clock signals, power signals, and other types of standard, non-standard, and proprietary interfaces and combinations thereof that have been developed, are being developed, or will be developed in the future.

Various embodiments of the present invention can incorporate one or more of these and the other features described herein. A better understanding of the nature and advantages of the present invention can be gained by reference to the following detailed description and the accompanying drawings.

DESCRIPTION OF ILLUSTRATIVE EMBODIMENTS

Figure 1:
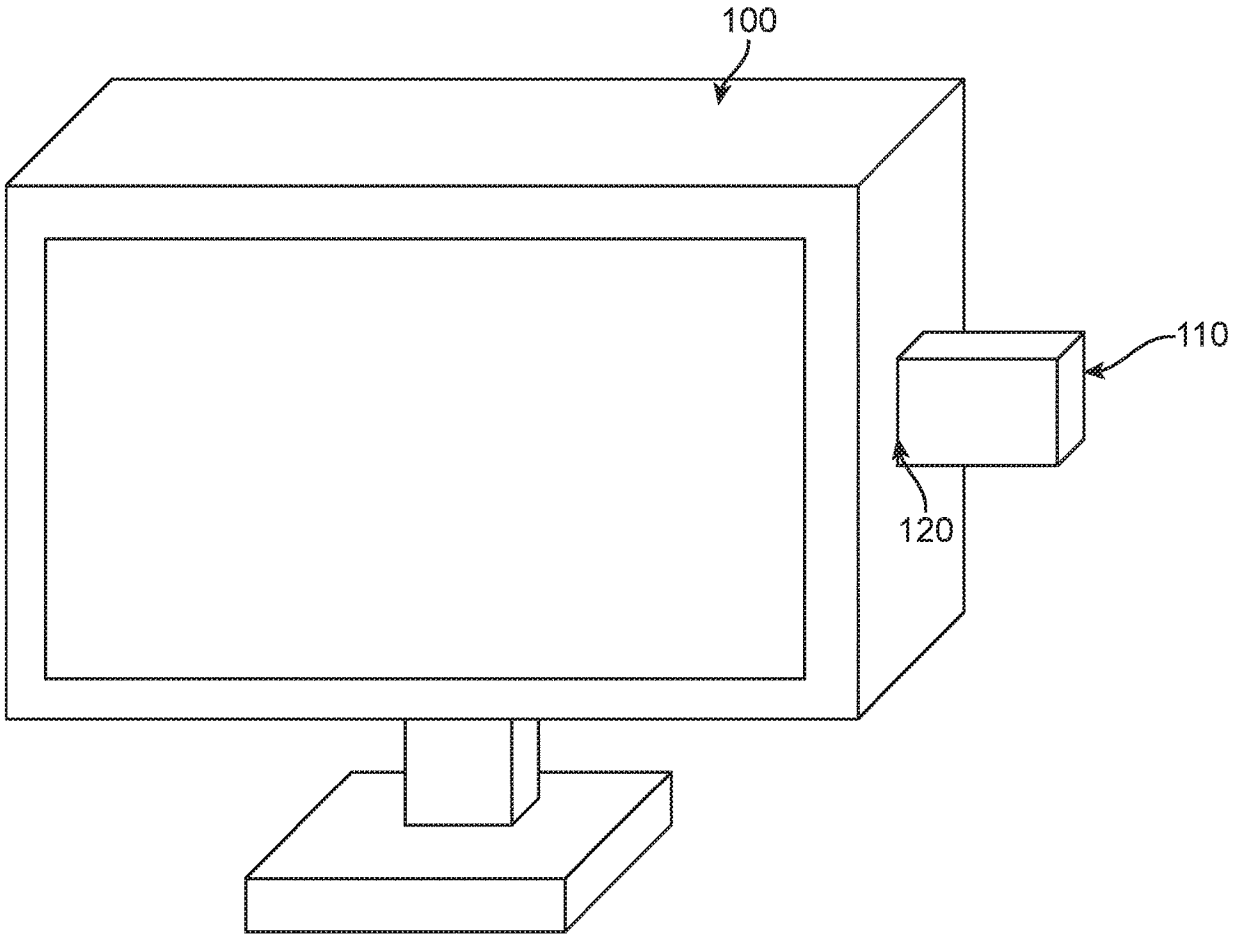
FIG. 1 illustrates an electronic device that can be improved by the incorporation of embodiments of the present invention.

FIG. 1 illustrates an electronic device 100 that can be improved by the incorporation of embodiments of the present invention. In this particular example, electronic device 100 can be a monitor or an all-in-one computer. Other types of electronic devices, such as portable media players, storage devices, tablets, netbooks, laptops, desktops, wearable computing devices, cell, media, and smart phones, televisions, and other display devices, navigation systems, and other types of devices can also be improved by the incorporation of embodiments of the present invention.

In this example, card 110 can be inserted into connector receptacle 120 located in the housing of electronic device 100. In a specific embodiment of the present invention, connector receptacle 120 can be arranged to receive a Secure Digital memory card 110. In other embodiments of the present invention, connector receptacle 120 can be configured to receive other types of memory cards or electronic devices, modules, or connections to other electronic devices, such as a cable or docking station insert. These and other devices can be referred to collectively as cards.

Again, it can be desirable to reduce the space inside electronic device 100 that is consumed by connector receptacle 120. By shrinking the space consumed by connector receptacle 120, electronic device 100 can be made smaller, can include additional functionality, or both.

In various embodiments of the present invention, the space consumed by connector receptacle 120 can be reduced by reducing its depth. But reducing the depth of connector receptacle 120 can lead to potential vulnerabilities. For example, a user can incorrectly insert card 110. That is, a user can incorrectly insert card 110 at an oblique angle relative to the connector receptacle 120. Because connector receptacle 120 is shallow, contacts in connector receptacle 120 can be relatively close to the surface of the enclosure of electronic device 100. When a user inserts card 110 improperly, a corner or edge of card 110 can strike one or more contacts at an angle, thereby possibly causing damage.

Accordingly, embodiments of the present invention can provide connector receptacles having one or more protective doors to protect contacts in a connector receptacle. An example is shown in the following figure.

Figure 2:
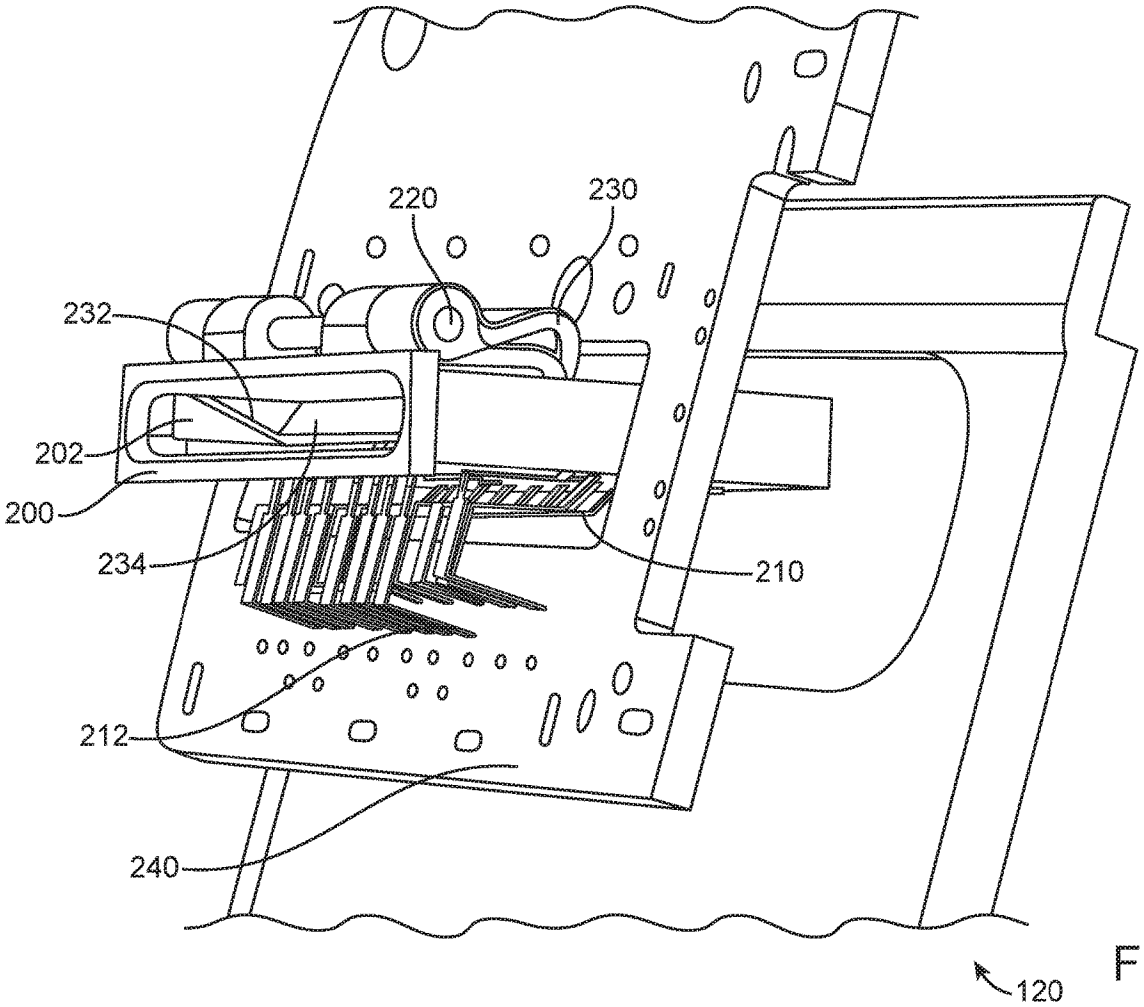
FIG. 2 illustrates a connector receptacle according to an embodiment of the present invention.

FIG. 2 illustrates a connector receptacle according to an embodiment of the present invention. This figure, as with the other included figures, is shown for illustrative purposes and does not limit the possible embodiments of the present invention or the claims.

Connector receptacle 120 can be used as connector receptacle 120 as shown in FIG. 1 or as a connector receptacle in other embodiments of the present invention. Connector receptacle 120 can include housing 200 having a front opening 202 for accepting a card, such as card 110 in FIG. 1. A number of contacts 210 can have contacting portions (not shown) in housing 200. Contacts 210 can further include through-hole contacting portions 212, which can be inserted into openings in printed circuit board or other appropriate substrate 240.

Connector receptacle 120 can further include cam 230 having a door. The door can have a face for engaging a front edge of a card when the card is inserted into connector receptacle 120. The face of the door can include a mix of features including a first feature or forward ramp 232 and a second feature or reverse ramp 234. Cam 230 can be hinged by pin 220 and can rotate about an axis along pin 220.

When a card is properly inserted into connector receptacle 120, the card can engage the first feature or forward ramp 232. Forward ramp 232 can ride up along the front edge of the card as the card is inserted into connector receptacle 120. This can move the face of the door of cam 230 out of the way allowing the card to access contacting portions of contacts 210.

When a card is improperly inserted, a corner of the card can engage the second feature or reverse ramp 234. The corner of the card can cause cam 230 to be pushed down, thereby closing the door and preventing access of contacting portions 214 of contacts 210 by the card. This closed door can also prevent the ingress of moisture, dust, debris, or other particulate matter.

In these and other embodiments of the present invention, cam 230 can be biased in a downward position such that the door remains closed when a card is not inserted into connector receptacle 120. This biasing can be done by a spring or a magnet. For example, a spring plate can be used to bias cam 230 in a closed position.

Figure 3:
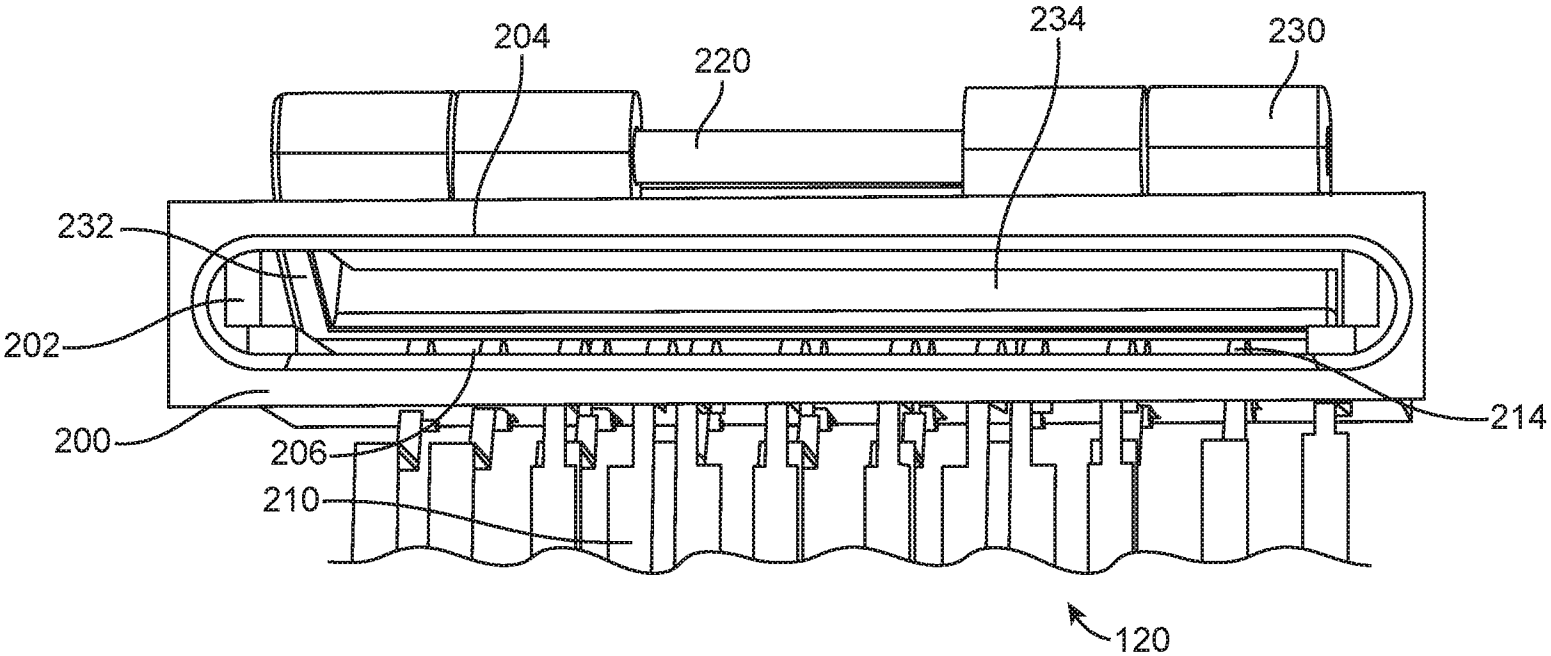
FIG. 3 illustrates a front view of a connector receptacle according to an embodiment of the present invention.

FIG. 3 illustrates a front view of a connector receptacle according to an embodiment of the present invention. In this example, a door of cam 230 can be closed or at least partially closed. In this partially closed state, the door of cam 230 can prevent access to contacting portions 214 of contacts 210 by a card. Again, cam 230 can rotate about an axis provided by pin 220. Cam 230 can include a door including a first feature, shown here as forward ramp 232. The door can further have a second feature, shown here as reverse ramp 234. Forward ramp 232 can extend from near a bottom of front opening 202 in housing 200 to a top 204 of front opening 202 in housing 200. Forward ramp 232 can be closer to front opening 202 near top 204 a front opening 202 and further from front opening 202 near a bottom 206 of front opening 202. By contrast, second feature or reverse ramp 234 can be located at approximately a same distance at a top 204 and bottom 206 of front opening 202, or reverse ramp 234 can have a greater depth near top 204 of front opening 202 as compared to a bottom 206 in front opening 202.

Figure 4:
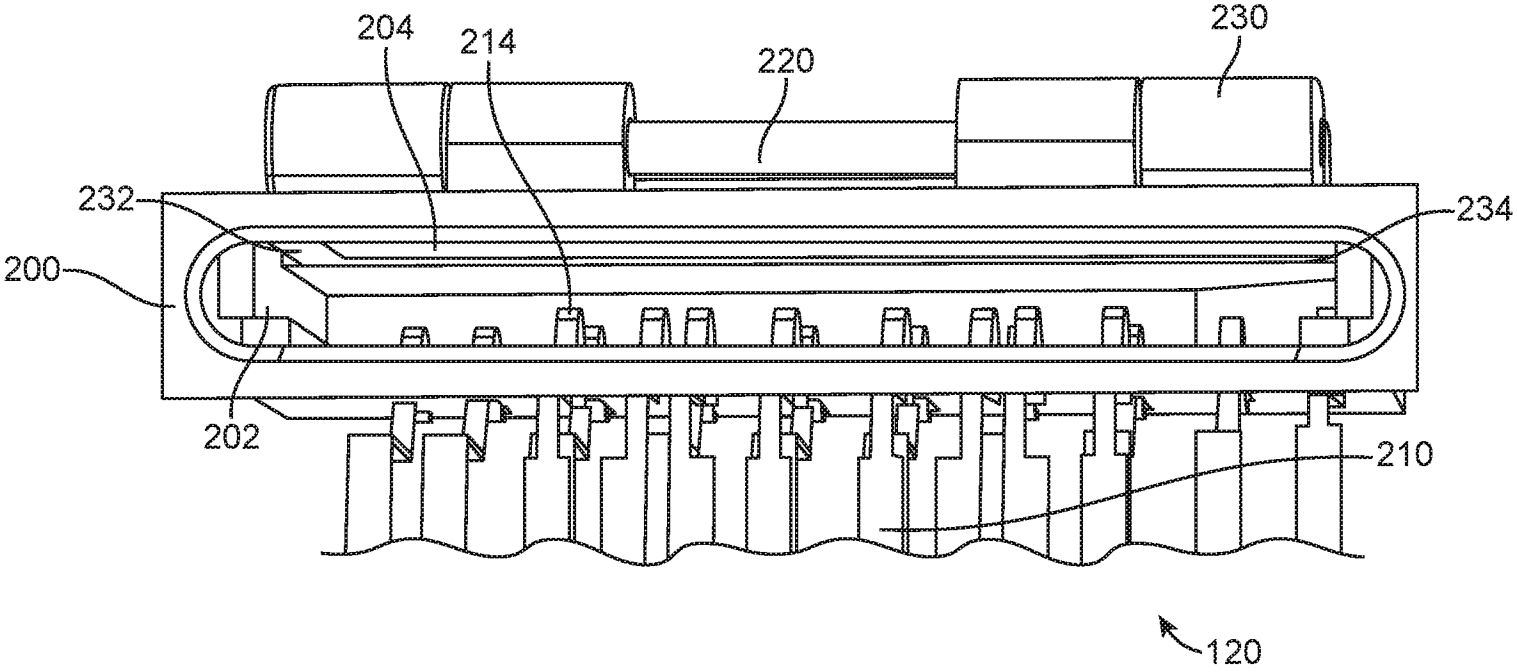
FIG. 4 illustrates another front view of a connector receptacle according to an embodiment of the present invention.

FIG. 4 illustrates another front view of a connector receptacle according to an embodiment of the present invention. In this case, the door of cam 230 can be opened. Specifically, cam 230 can be rotated about the first axis provided by pin 220 such that forward ramp 232 and reverse ramp 234 can be located in a top 204 of housing 200. This can expose contacts 210 in front opening 202 of housing 200.

Figure 5:
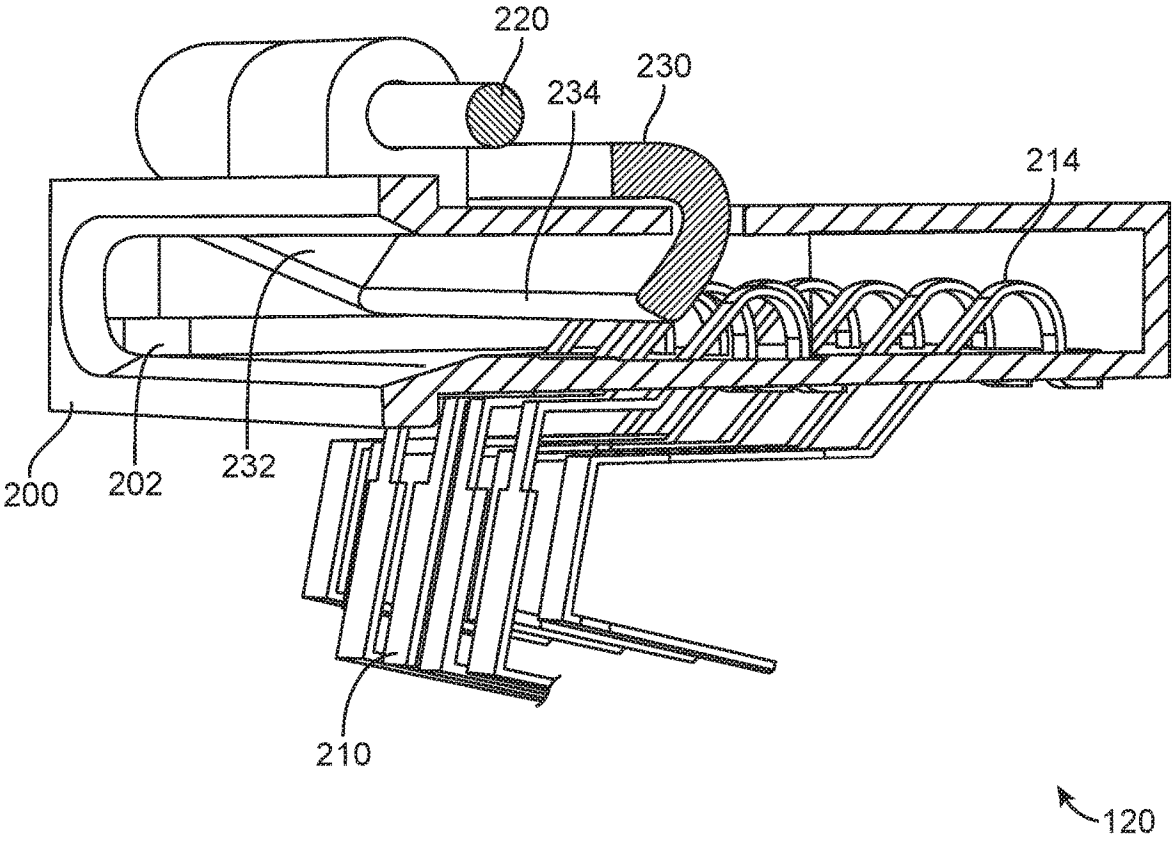
FIG. 5 illustrates a cutaway side view of a connector receptacle according to an embodiment of the present invention.

FIG. 5 illustrates a cutaway side view of a connector receptacle according to an embodiment of the present invention. In this example, a door provided by cam 230 can be closed. Again, cam 230 can rotate about an axis provided by pin 220. Contacting portions 214 of contacts 210 can be located in housing 200 behind the door consisting of first feature or forward ramp 232 and second feature or reverse ramp 234.

Figure 6:
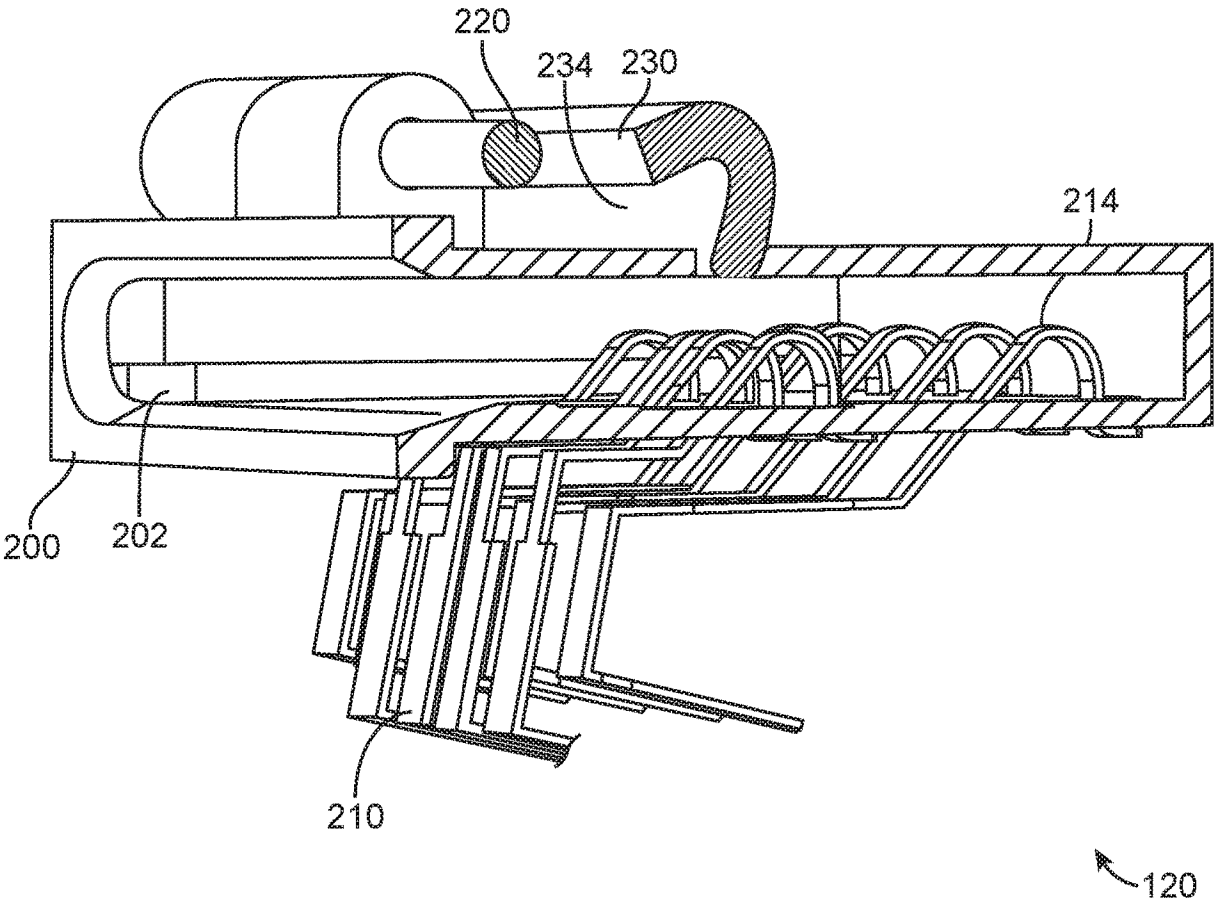
FIG. 6 illustrates another cutaway side view of a connector receptacle according to an embodiment of the present invention.

FIG. 6 illustrates another cutaway side view of a connector receptacle according to an embodiment of the present invention. In this example, a door provided by cam 230 can be opened. Again cam 230 can rotate about an axis provided by pin 220. Contacting portions 214 of contacts 210 can be available through front opening 202 in housing 200. In this example, a first feature or forward ramp 232 (not shown) and reverse ramp 234 can be pushed up out of the insertion path of a card in housing 200.

Figure 7:
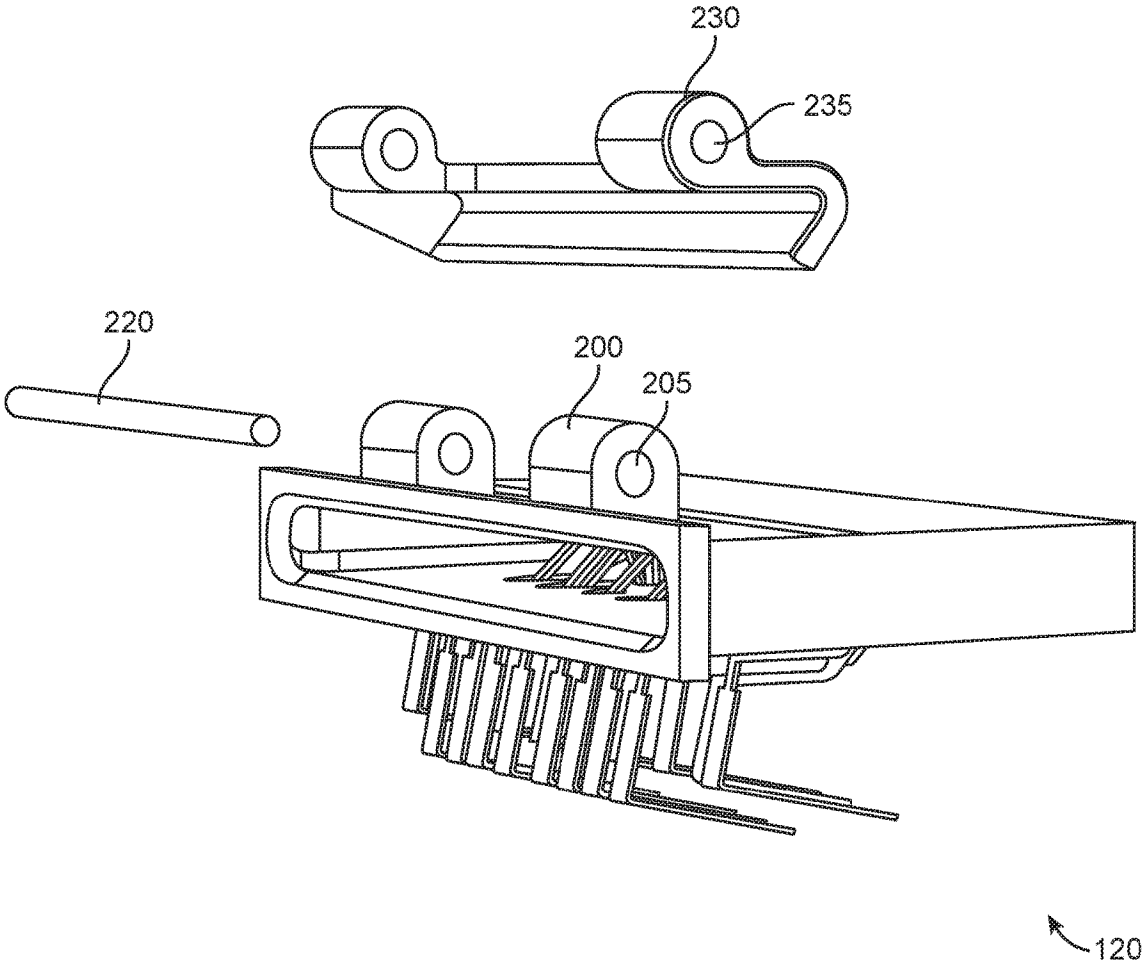
FIG. 7 illustrates the assembly of a connector receptacle according to an embodiment of the present invention.

FIG. 7 illustrates the assembly of a connector receptacle according to an embodiment of the present invention. Pin 220 can pass through openings 235 in cam 230 and openings 205 in housing 200 to secure cam 230 to housing 200 and provide an axis of rotation for cam 230.

Figure 8:
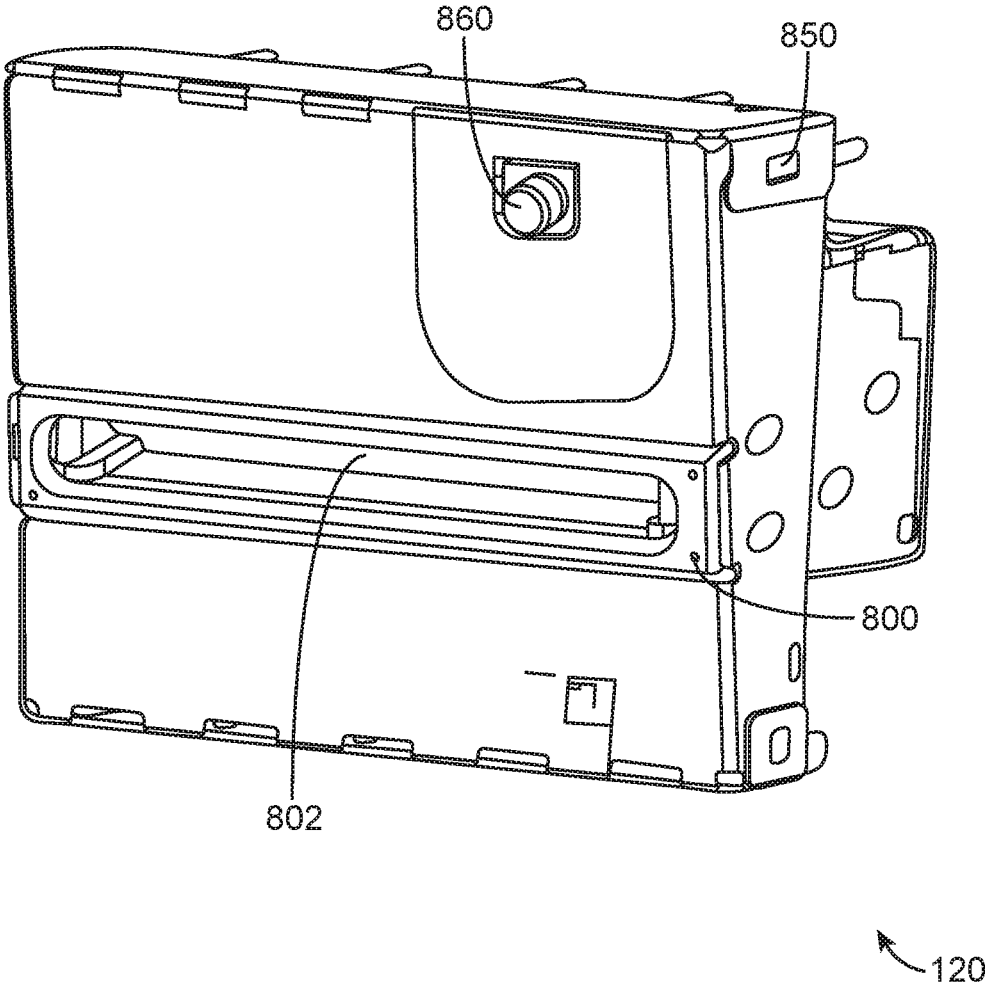
FIG. 8 illustrates another connector receptacle according to an embodiment of the present invention.
Figure 9:
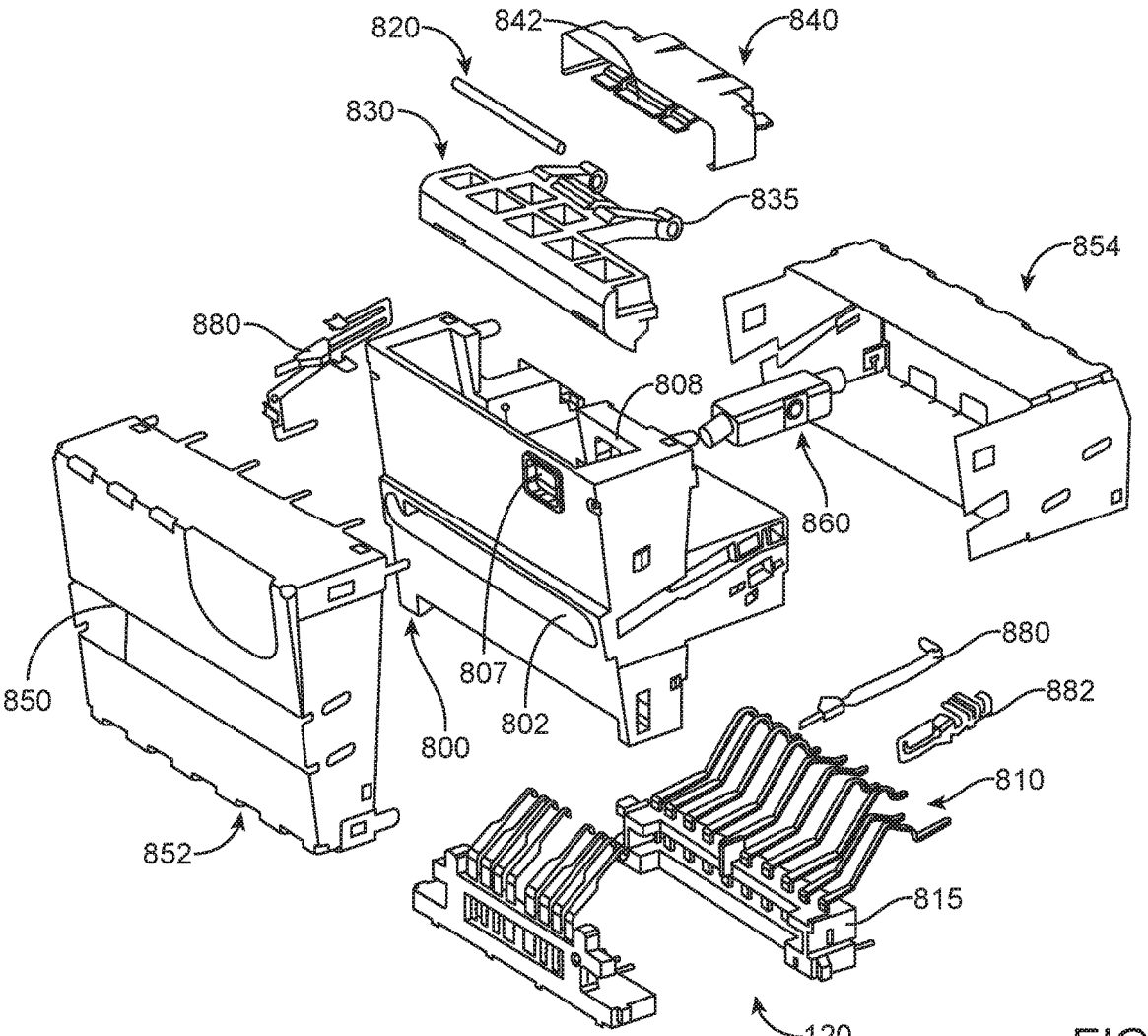
FIG. 9 is an exploded view of the connector receptacle of FIG. 8.

FIG. 8 illustrates another connector receptacle according to an embodiment of the present invention. Again, this connector receptacle can be used as connector receptacle 120 in FIG. 1, or as a connector receptacle in other embodiments of the present invention. Connector receptacle 120 can include an opening 802 in housing 800 for receiving a card. Housing 800 can be at least partially shielded by shielding 850. An alignment pin 860 can be placed in housing 800 or formed as a portion of housing 800. In this example, alignment pin 860 can pass through openings 807 and 808 (as shown in FIG. 9.) Alignment pin 860 can fit in an openings or recess in a device enclosure for an electronic device housing connector receptacle 120, in order to align connector receptacle 120 to the device enclosure.

FIG. 9 is an exploded view of the connector receptacle 120 of FIG. 8. Housing 800 can include openings 807 and 808 for accepting alignment pin 860. Alignment pin 860 can fit in a recess or opening in a device enclosure for an electronic device housing connector receptacle 120. Housing 800 can be at least partially shielded by shield 850, shown here as front shield portion 852 and a rear shield portion 854. Cam 830 can include a front door to be positioned opening 802 in housing 800 to block access of contacts 810 by an improperly inserted card. Pin 820 can pass through openings 835 in cam 830 and openings (not shown) in housing 800. Pin 820 can allow cam 830 to rotate about an axis provided by pin 820. Spring plate 840 can include spring fingers 842 to provide a downward bias to cam 830, thereby keeping the door provided by cam 830 closed in the absence of a card inserted into connector receptacle 120. Contacts 810 can be formed in two rows, each partially molded in an insert housing portion 815. Other contacts such as ground contacts and detect pins 880 and 882, can also be included.

Figure 10:
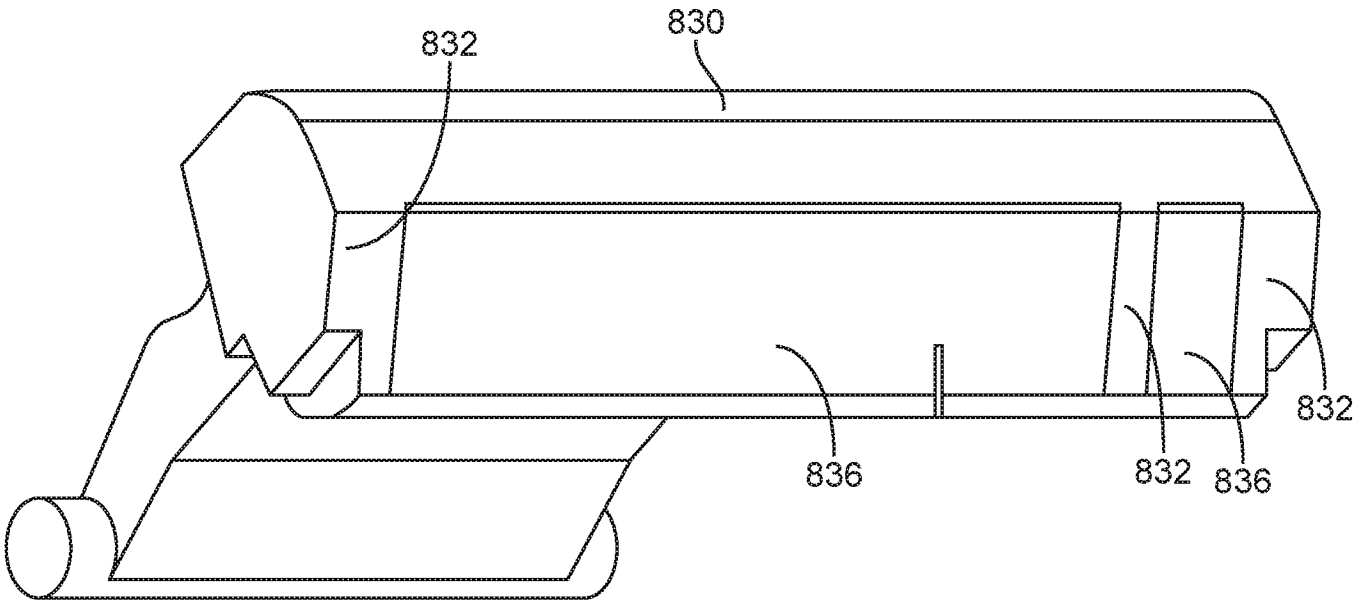
FIG. 10 illustrates a more detailed view of a cam including a door according to an embodiment of the present invention.
Figure 11:
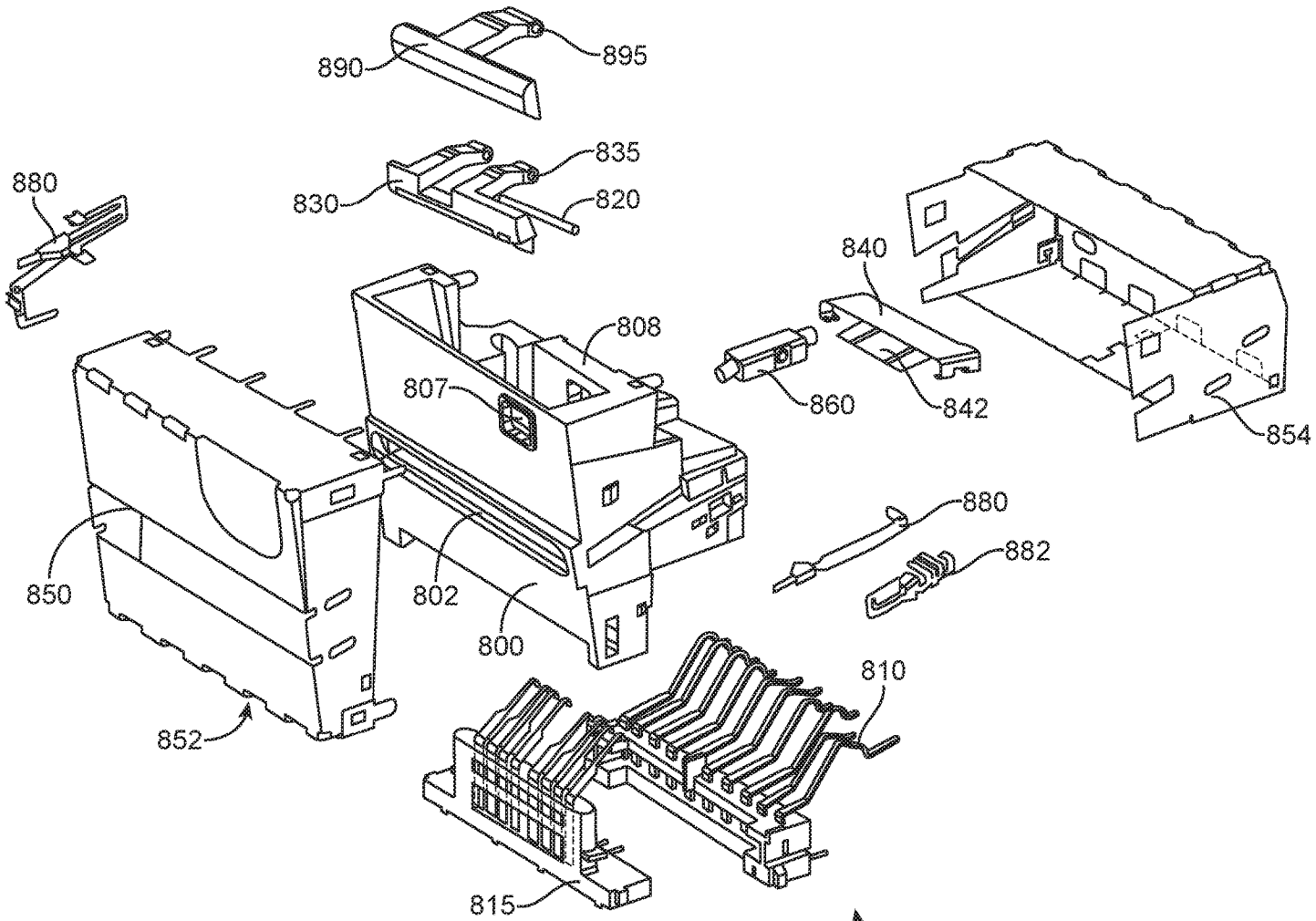
FIG. 11 is another exploded view of the connector receptacle of FIG. 8.

FIG. 10 illustrates a more detailed view of a cam including a door according to an embodiment of the present invention. In this example, cam 830 can include door having a face for engaging a leading edge of a card as the card is inserted into connector receptacle 120 (as shown in FIG. 11.) The face can include a first feature, rib or forward ramp 832. More specifically, the face can include as one, two, three, or more than three ribs or forward ramps 832 as shown. As before, the face of the door of cam 830 can include a reverse ramp, similar to reverse ramp 234, as shown in FIG. 2. The reverse ramp can be located in regions 836, shown here as two regions between the three ribs or forward ramps 832. To improve an appearance and functionality of cam 830, the reverse ramp in regions 836 can be over molded or filled with an elastomeric or other type of compound. This elastomeric or other compound in regions 836 can form a smoothed surface with forward ramp 832. When a corner of an improperly inserted card engages elastomeric material in region 836, the card can provide a downward force, thereby closing the door and protecting contacts 810 (as shown in FIG. 9.) The characteristics of forward ramp 832 can be similar to those of forward ramp 232 (as shown in FIG. 2), while the characteristics of the reverse ramps in regions 836 can be similar to those of reverse ramp 234 (as shown in FIG. 2.)

In these and other embodiments of the present invention, instead of filling in a face of a door of cam 830 with an elastomer to provide a smooth surface, a second door having a more uniform appearance can be included. The second door can be between the door shown in FIG. 10 and a front opening of connector receptacle 120. An example is shown in the following figure.

FIG. 11 is another exploded view of the connector receptacle of FIG. 8. Housing 800 can include openings 807 and 808 for accepting alignment pin 860. Alignment pin 860 can fit in a recess or opening in a device enclosure housing connector receptacle 120. Housing 800 can be at least partially shielded by shield 850, shown here as front shield portion 852 and a rear shield portion 854. First cam 830 can include a front door to be positioned in housing 800 to block access of contacts 810 by an improperly inserted card. Second cam 890 can be in front of first cam 830 to improve functionality and improve appearance. Second cam 890 can provide additional sealing to protect against the ingress of moisture and debris. Pin 820 can pass through openings 835 in first cam 830, opening 895 in second cam 890, and openings (not shown) in housing 800. Pin 820 can allow first cam 830 and second cam 890 to rotate independently about an axis provided by pin 820. Spring plate 840 can include spring fingers 842 to provide a downward bias to first cam 830 and second cam 890, thereby keeping the doors provided by cams 830 and 890 closed in the absence of a card inserted into connector receptacle 120. Contacts 810 can be formed in two rows, each partially molded in an insert housing portion 815. Other contacts such as ground contacts and detect pins 880 and 882, can also be included.

Figure 12:
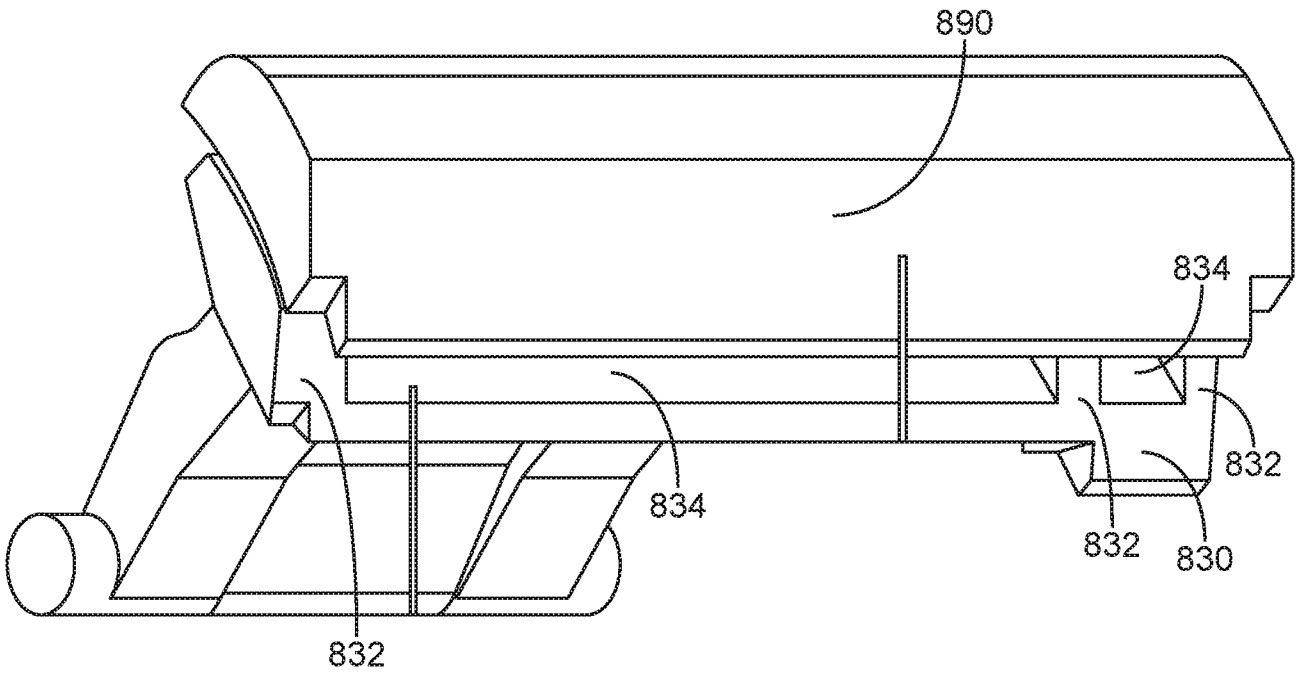
FIG. 12 illustrates the cams that can be used in the dual-cam arrangement shown in FIG. 11.

FIG. 12 illustrates the cams that can be used in the dual-cam arrangement shown in FIG. 11. These cams can be used in the dual-cam arrangement of FIG. 11 or in other dual-cam arrangements in other embodiments of the present invention. A first or rear cam 830 can include a first feature or forward ramp 832 and a second feature or reverse ramp 834, as shown above. In this example, three ribs or forward ramps 832 can be included, though other number of ramps or ribs can be used. This dual-cam arrangement can further include a second or front cam 890. In various embodiments of the present invention, second or front cam 890 can include a door having uniform face for cosmetic and functional reasons.

During in improper insertion of a card, second cam 890 can move out of the way, allowing a corner of the card to engage second feature or reverse ramp 834 of first cam 830. This engagement can push down on cam 830, thereby closing the door to the card and preventing access of contacts in the connector receptacle by the card.

During a proper insertion of a card, second cam 890 can again move out of the way allowing the front edge of the card to engage first feature or forward ramp 832 of first cam 830. Forward ramp 832 can ride up along a front edge of the card as the card is inserted, thereby moving the door of cam 830 out of the way and allowing the card to access contacts in the connector receptacle.

In various embodiments of the present invention, it can be desirable to provide a somewhat low and reducing or uniform amount of resistance to the insertion of a properly inserted card. This resistance can be adjusted by modifying an interface between spring plate 840 (shown in FIG. 9) and cam 830. It can further be adjusted or modified by changing a profile of first feature or forward ramp 832. Examples are shown in the following figures.

Figure 13:
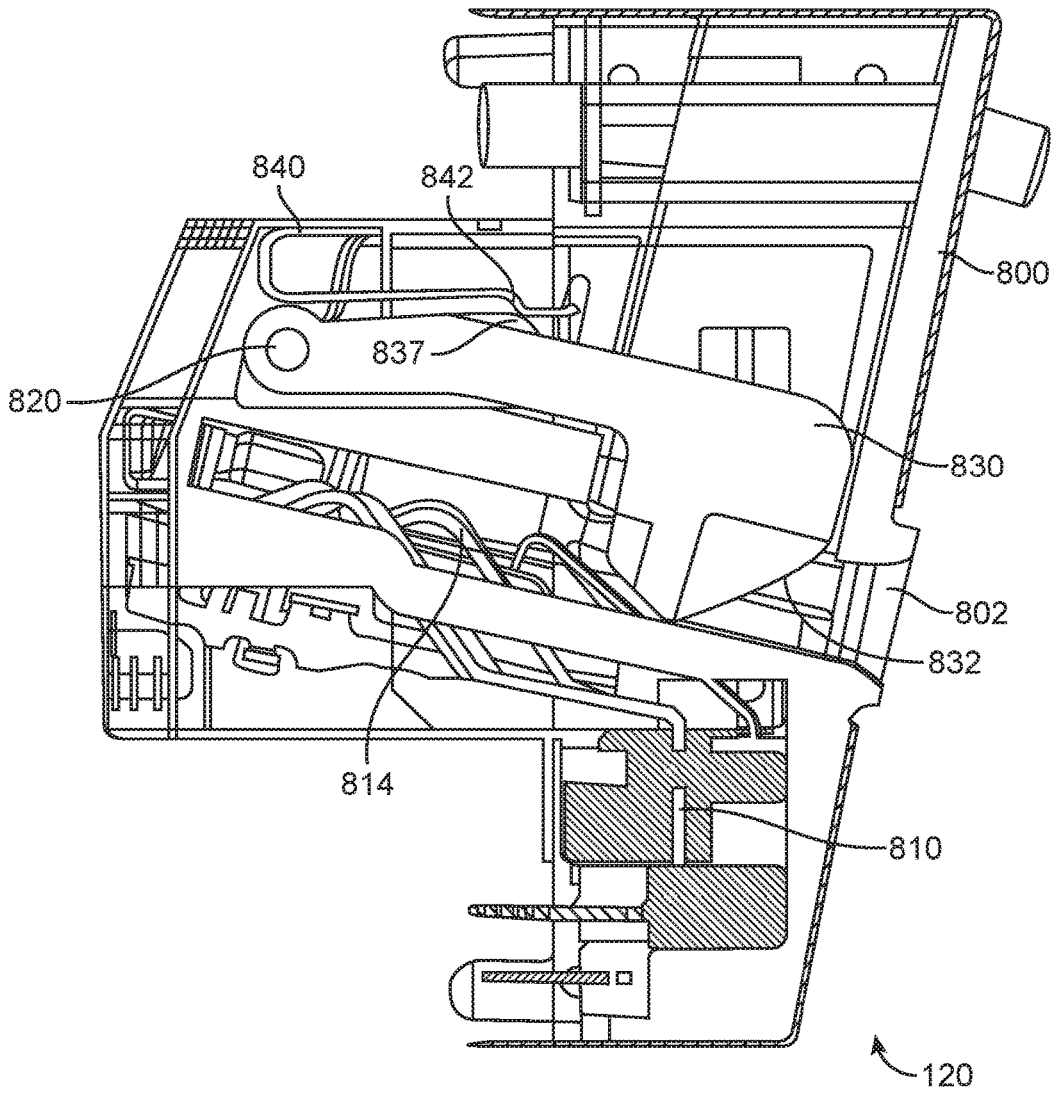
FIG. 13 illustrates a transparent view of a connector receptacle according to an embodiment of the present invention.

FIG. 13 illustrates a transparent view of a connector receptacle according to an embodiment of the present invention. In this example, spring plate 840 can include spring fingers 842, which can push down on cam 830, thereby protecting contacting portions 814 of contacts 810. This closed door can also prevent the ingress of moisture, dust, debris, or other particulate matter.

As a leading edge of a card engages a profile of first feature or forward ramp 832, cam 830 can rotate about pin 820 and be pushed up out of opening 802 in housing 800. Feature 837 on cam 830 can push up against spring fingers 842, and spring fingers 842 can provide a resistance to the insertion of the card. Accordingly, a shape of spring fingers 842 and feature 837 can be adjusted to provide a reduced or uniform resistance force to the insertion of the card.

Figure 14:
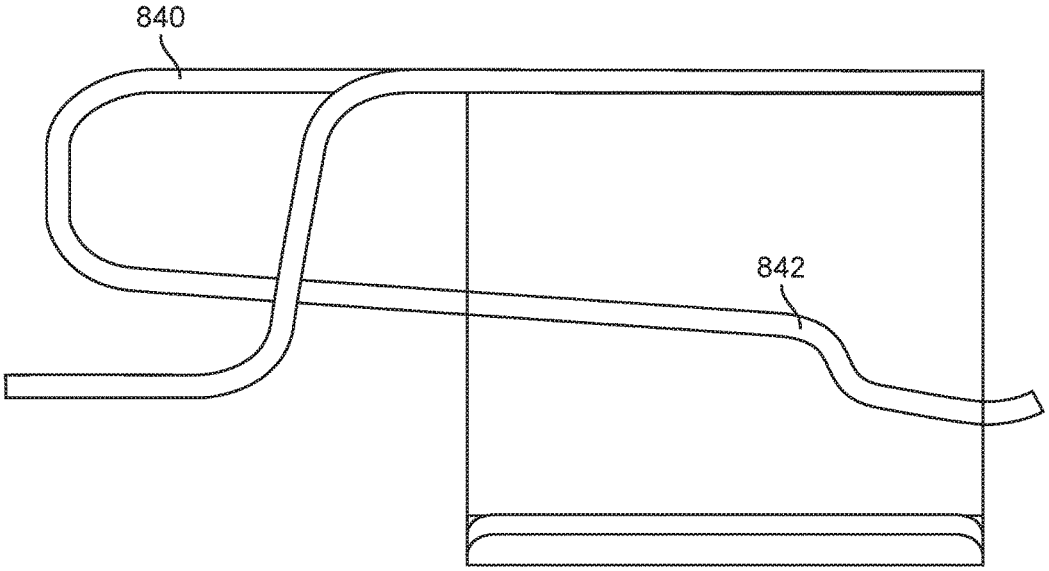
FIG. 14 illustrates a shape of a spring finger according to an embodiment of the present invention.

FIG. 14 illustrates a shape of a spring finger according to an embodiment of the present invention. Spring finger 842 of spring plate 840 can have a downward deflection as shown.

Figure 15:
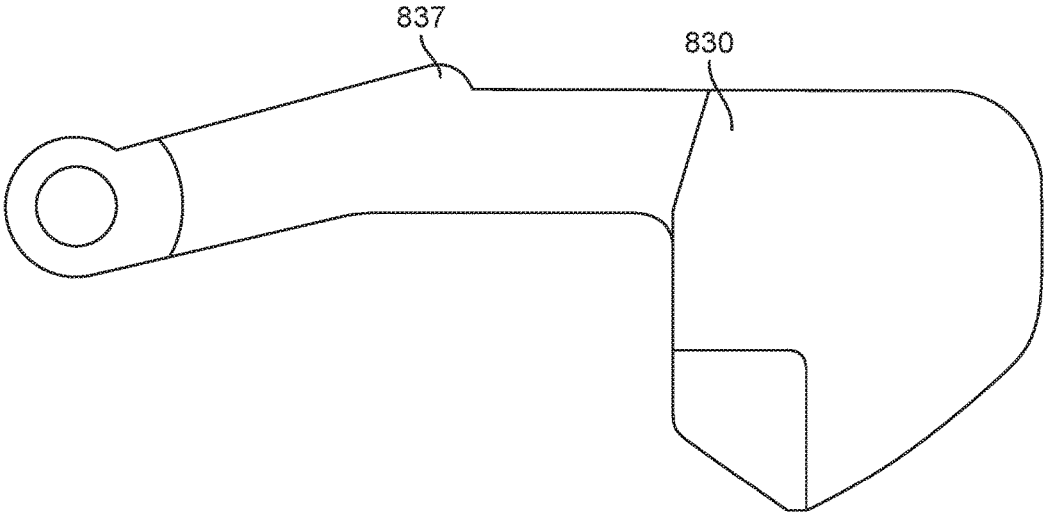
FIG. 15 illustrates a shape of a cam feature according to an embodiment of the present invention.

FIG. 15 illustrates a shape of a cam feature according to an embodiment of the present invention. Cam 830 can include feature 837 having a shape as shown to engage with spring finger 842 as shown in FIG. 14. The engagement of feature 837 and spring finger 842 can provide a reduced and at least somewhat uniform resistance to the insertion of a card into connector receptacle 120.

Figure 16:
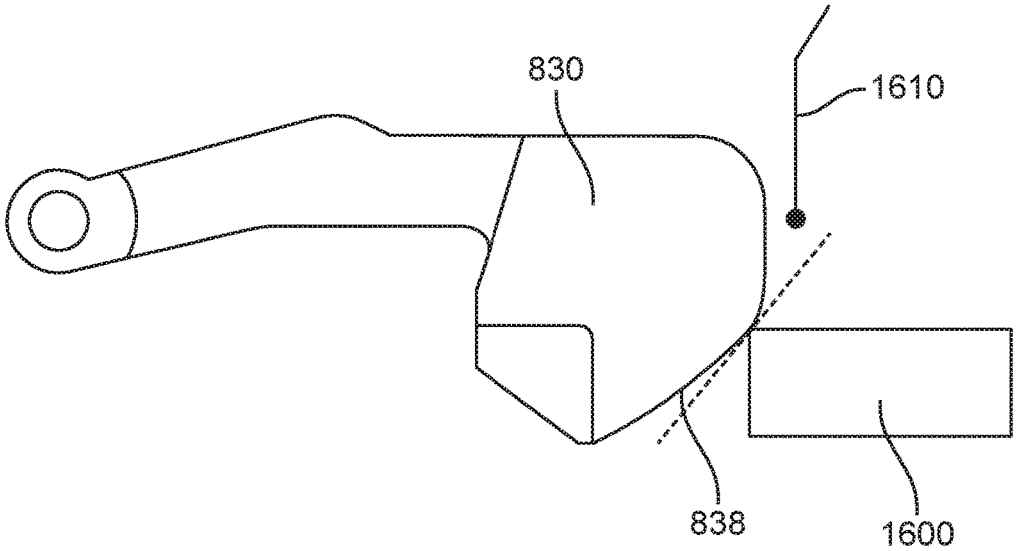
FIG. 16 illustrates the engagement of a card and a face of a door of a cam according to an embodiment of the present invention.
Figure 16:
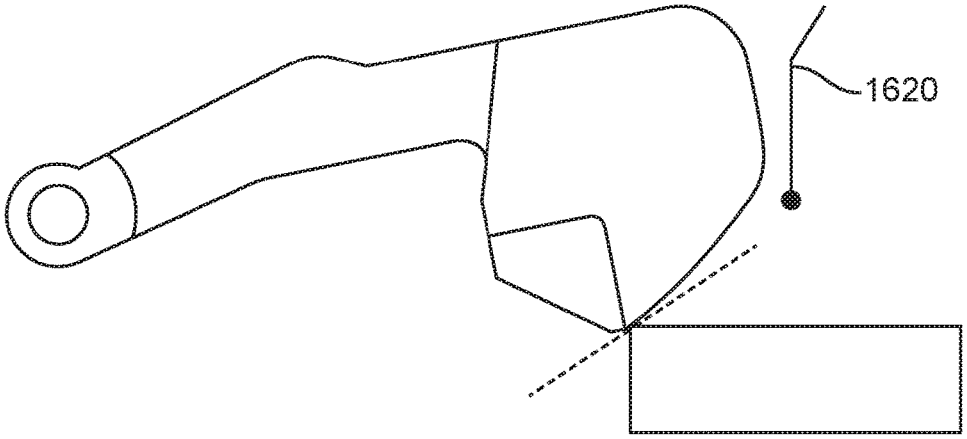

FIG. 16 illustrates the engagement of a card and a face of a door of a cam according to an embodiment of the present invention. In this example, card 1600 can engage cam 830 at surface 838. Surface 838, which can be a surface of ribs or forward ramps 832, can be generally convex, as can be the other faces of the other cams included herein. When card 1600 initially engages surface 838, a resulting angle 1610 can result. Angle 1610 can be approximately 45 degrees or it can be another angle. For example, it can be between 40 and 50 degrees. As card 1600 is further inserted, an angle between card 1600 and surface 838 can be reduced. For example, the resulting angle 1620 can reduce to an angle of approximately 35 degrees or it can be another angle. For example, it can be between 30 and 40 degrees. This can make it progressively easier to push the card into the connector receptacle 120.

In various embodiments of the present invention, the components of connector receptacles can be formed in various ways of various materials. For example, contacts or pins and other conductive portions of the receptacles can be formed by stamping, metal-injection molding, machining, micro-machining, 3-D printing, or other manufacturing process. The conductive portions can be formed of stainless steel, steel, copper, copper titanium, phosphor bronze, or other material or combination of materials. They can be plated or coated with nickel, gold, or other material. The nonconductive portions, such as the protective pieces, receptacle housings and other portions can be formed using injection or other molding, 3-D printing, machining, or other manufacturing process. The nonconductive portions can be formed of silicon or silicone, rubber, hard rubber, plastic, nylon, elastomers, liquid-crystal polymers (LCPs), ceramics, or other nonconductive material or combination of materials.

Embodiments of the present invention can provide connector receptacles that can be located in, and can connect to, various types of devices, such as portable computing devices, tablet computers, desktop computers, laptops, all-in-one computers, wearable computing devices, cell phones, smart phones, media phones, storage devices, portable media players, navigation systems, monitors, power supplies, adapters, remote control devices, chargers, and other devices. These connector receptacles can provide pathways for signals and power for cards or other modules, such as Ultra-High-Speed II Secure Digital cards, Secure Digital cards, Secure Digital High Capacity cards, Secure Digital Extended Capacity cards, Secure Digital Ultra-High-Capacity I cards, Secure Digital Ultra-High-Capacity II cards, memory sticks, compact flash cards, communication modules, and other devices and modules that have been developed, are being developed, or will be developed in the future. These connector receptacles can provide pathways for signals that are compliant with various standards such as Universal Serial Bus, High-Definition Multimedia Interface®, Digital Visual Interface, Ethernet, DisplayPort, Thunderbolt™, Lightning™, Joint Test Action Group, test-access-port, Directed Automated Random Testing, universal asynchronous receiver/transmitters, clock signals, power signals, and other types of standard, non-standard, and proprietary interfaces and combinations thereof that have been developed, are being developed, or will be developed in the future.

The above description of embodiments of the invention has been presented for the purposes of illustration and description. It is not intended to be exhaustive or to limit the invention to the precise form described, and many modifications and variations are possible in light of the teaching above. The embodiments were chosen and described in order to best explain the principles of the invention and its practical applications to thereby enable others skilled in the art to best utilize the invention in various embodiments and with various modifications as are suited to the particular use contemplated. Thus, it will be appreciated that the invention is intended to cover all modifications and equivalents within the scope of the following claims.

What is claimed is:

1. A connector receptacle comprising:

a housing having a front opening to receive a card;

a plurality of contacts, each having a contacting surface to form an electrical connection with a corresponding contact on the card; and a cam including a door having a face, the face to engage a leading edge of the card as the card is inserted into the connector receptacle, the cam rotatable about a first axis, wherein when the door is closed, the door is between the contacting surfaces of the plurality of contacts and the front opening in the housing, wherein the face of the door comprises a first feature to allow the cam to open by rotating about the first axis when the card is properly inserted, and wherein the face of the door comprises a second feature to prevent the door from opening by preventing the cam from rotating about the first axis when the card is improperly inserted.

2. The connector receptacle of claim 1 wherein the first feature comprises a forward ramp, where the forward ramp is angled from the first axis away from the front opening in the housing.

3. The connector receptacle of claim 2 wherein the second feature comprises a reverse ramp, where the reverse ramp is angled at an opposite direction as the forward ramp.

4. The connector receptacle of claim 1 wherein the first axis extends laterally along a top of and near the front opening in the housing.

5. The connector receptacle of claim 4 wherein the first feature comprises a forward ramp, where the forward ramp extends from the top of the front opening in the housing to a bottom of the front opening in the housing, where the forward ramp is near the first axis near the top of the housing and at a first position deeper in the housing near the bottom of the front opening in the housing.

6. The connector receptacle of claim 5 wherein the second feature comprises a reverse ramp, where the reverse ramp extends from the first position in the housing near the bottom of the front opening in the housing to a second position deeper in the housing near the top of the front opening in the housing.

7. The connector receptacle of claim 5 wherein the second feature comprises a flat surface, where the flat surface extends from the first position in the housing near the bottom of the front opening in the housing to a second position at approximately the same depth in the housing near the top of the front opening in the housing.

8. The connector receptacle of claim 7 further comprising a magnet to bias the door closed.

9. The connector receptacle of claim 7 wherein the first feature is located at a side of the front opening in the housing.

10. The connector receptacle of claim 7 wherein the first feature is located near a side of the front opening in the housing.

11. The connector receptacle of claim 7 further comprising a spring to bias the door closed.

12. The connector receptacle of claim 11 wherein the face of the door is partially covered by an elastomer.

13. A connector receptacle comprising:

a housing having a front opening to receive a card;

a plurality of contacts, each having a contacting surface to form an electrical connection with a corresponding contact on the card;

a first cam including a first door having a face, the face to engage a leading edge of the card as the card is inserted into the connector receptacle, the first cam rotatable about a first axis, wherein when the first door is closed, the first door is between the contacting surfaces of the plurality of contacts and the front opening in the housing; and a second cam including a second door having a face, the face to engage the leading edge of the card as the card is inserted into the connector receptacle, the second cam rotatable about the first axis, wherein when the second door is closed, the second door is between the first door and the front opening in the housing, wherein the face of the first door comprises a first feature to allow the first cam to open by rotating about the first axis when the card is properly inserted, and wherein the face of the first door comprises a second feature to prevent the first door from opening by preventing the first cam from rotating about the first axis when the card is improperly inserted.

14. The connector receptacle of claim 13 further comprising an alignment pin to fit in a recess in a device enclosure.

15. The connector receptacle of claim 13 wherein the second door can open when the card is improperly inserted.

16. The connector receptacle of claim 13 further comprising a spring to bias the first door and the second door closed.

17. The connector receptacle of claim 13 wherein the first axis extends laterally along a top of and behind the front opening in the housing.

18. The connector receptacle of claim 17 wherein the first feature comprises a forward ramp, where the forward ramp extends from the top of the front opening in the housing to a bottom of the front opening in the housing, where the forward ramp is nearer to the front opening in the housing near a top of the housing and further from the front opening in the housing near a bottom of the housing.

19. The connector receptacle of claim 18 wherein the second feature comprises a reverse ramp, where the reverse ramp extends from the top of the front opening in the housing to the bottom of the front opening in the housing, where the reverse ramp is nearer to the front opening in the housing near the bottom of the housing and further from the front opening in the housing near the top of the housing.

20. The connector receptacle of claim 18 wherein the second feature comprises a flat surface, where the flat surface extends from the top of the front opening in the housing to the bottom of the front opening in the housing, where the flat surface is approximately the same depth from the front opening in the housing near the bottom of the housing as it is from the front opening in the housing near the top of the housing.

* * * * *